United States Patent [19]

Goldberg

[11] 4,183,750

[45] Jan. 15, 1980

[54] COLOR FILM AND PROCESS FOR DEVELOPING IT

[76] Inventor: Richard J. Goldberg, 4814 Brandenburg St., Tarzana, Calif. 91356

[21] Appl. No.: 815,947

[22] Filed: Jul. 15, 1977

Related U.S. Application Data

[63] Continuation of Ser. No. 724,280, Sep. 20, 1976, abandoned, which is a continuation of Ser. No. 572,291, Oct. 7, 1974, abandoned.

[51] Int. Cl.[2] ..... G03C 7/16

[52] U.S. Cl. ..... 430/264; 430/364; 430/379

[58] Field of Search ..... 96/8, 9, 11, 12, 55, 96/74, 22

[56] References Cited

U.S. PATENT DOCUMENTS

| | | | |
|---|---|---|---|
| 2,132,154 | 10/1938 | Gaspar | 96/12 |
| 2,252,718 | 8/1941 | Mannes et al. | 96/22 |
| 2,336,243 | 12/1943 | Hanson | 96/8 |
| 2,439,901 | 4/1948 | Neumann | 96/12 |
| 2,476,541 | 7/1949 | Friedman | 96/8 |
| 2,635,959 | 4/1953 | Harsh et al. | 96/8 |
| 3,362,820 | 1/1968 | Hellmig | 96/9 |
| 3,497,350 | 2/1970 | Yutzy et al. | 96/74 |
| 3,734,735 | 5/1973 | Bories | 96/55 |
| 3,940,271 | 2/1976 | Kawai et al. | 96/4 |

FOREIGN PATENT DOCUMENTS

| | | | |
|---|---|---|---|
| 541266 | 11/1941 | United Kingdom | 96/8 |

*Primary Examiner*—J. Travis Brown

*Attorney, Agent, or Firm*—Marvin Feldman; Stephen E. Feldman

[57] ABSTRACT

A color film and a process for developing it in which the usual color image is given increased sharpness and resolution by the provision of a metallic silver image in a single layer of the emulsion.

16 Claims, 9 Drawing Figures

EXPOSURE

FIRST DEVELOPER

REVERSAL BLEACH

COLOR DEVELOPER

SILVER REOXIDATION

RE-EXPOSE

THIRD DEVELOPER

FIX

COLOR FILM AND PROCESS FOR DEVELOPING IT

This is a continuation of application Ser. No. 724,280, filed Sept. 20, 1976, now abandoned, which in turn is a continuation of application Ser. No. 572,291, filed Oct. 7, 1974, now abandoned.

BACKGROUND OF THE INVENTION

In present day color photography the effect of color is obtained by three or more emulsions that are superimposed on a base with optical filters between the layers of emulsions. The base may be a transparent one such as a sheet of cellulose acetate, or it may be an opaque one such as a sheet of paper. Additional layers may be present such as antihalation layers, etc. Essentially the color is found in, generally, three separate emulsion layers. Each of the unexposed layers contains a light sensitive silver salt or silver halide and some form of coloring material that is originally substantially colorless but which during the processing of the film is converted to a color in proportion to the amount of silver in the silver image.

The nature of the photographic process is such that a color image can not be any sharper than the original silver image which it replaces and very often the color image loses a certain amount of detail or resolution. Because of the nature of the color process itself, it is difficult to increase the resolution of the color images, but it has been found possible to increase the resolution of the overall image by making use of a thin silver image in conjunction with the color image.

SUMMARY OF THE INVENTION

The present invention relates to a color film and to the process of developing that color film so that the over-all resolution of the film is improved, this being accomplished by providing a thin silver image in the outermost layer of emulsion on the film and by selectively tanning the emulsions. While the example given herein is for a color-reversal film, it will be obvious that the same concept applies to color negative film and color positive film with the appropriate simple modifications. Additionally, the term "film" as used herein includes images on opaque and translucent bases as well as transparent bases. Broadly stated, the invention contemplates the method of processing a multi-emulsion color film which includes the steps of exposing the film, color developing to form a color image in the film, and forming a final silver image in register with the color image and in the outermost of the emulsions.

PROCESSING OF COLOR REVERSAL FILM

Figure 2:
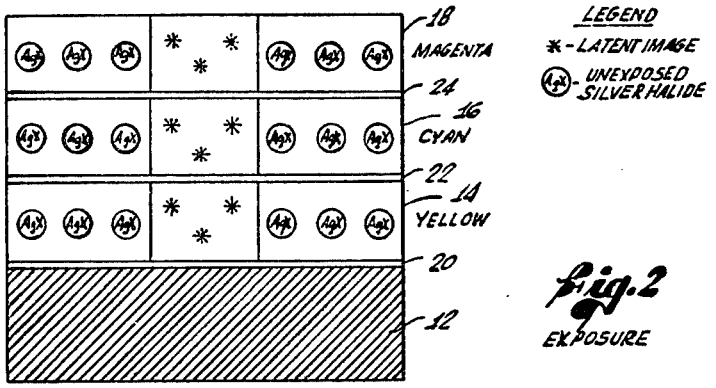
FIG. 2 is a fragmentary cross-sectional view, to an enlarged scale, of a section of film immediately after exposure and before any processing has occurred.

Considering first FIG. 2 of the drawings there is shown a representation of a cross-section of color film having a transparent base 12 on which are placed a blue sensitive, yellow image emulsion 14, a red sensitive, cyan image emulsion 16, and a green sensitive, magenta image emulsion 18. It is to be understood that the yellow, cyan, and magenta images are not originally present in the film or the emulsions but are formed in the separate emulsions during the processing of the film as hereinafter described. However, for purposes of the present description, the emulsions 14, 16 and 18 will be referred to by the color of the images finally formed therein rather than by the original sensitivity of the separate emulsions.

In all of the color films considered herein, whether reversal films, or color negative or color positive films, it is understood, as is well known in the art, that each emulsion layer initially contains a light sensitive silver halide that is adapted to be converted to a designated color in a color development process in the presence of a color coupler. For example, in the exemplified embodiment each emulsion layer initially contains a light sensitive silver halide and a color coupler that is initially colorless or a neutral color, but which is converted to a designated color during the color development process.

In accordance with customary photographic practice, the emulsion layer 14 may be separated from the base 12 by a coating 20 which under certain circumstances may include an antihalation backing, and the emulsion 16 separated from the emulsion 14 by a layer 22, just as the emulsion 18 is separated from the emulsion 16 by a layer 24. It will be understood that the layers 22 and 24 may have colors incorporated in them to act as light filters.

It will be noted that the sequence of the emulsions 14, 16 and 18 upon the base 12 is somewhat different from that customarily associated with subtractive color films, but a film having the particular arrangement shown is presently available from Eastman Kodak Company under the trade designation SO 242. Furthermore, as will hereinafter become apparent, the herein described process for developing color films is applicable to both films having the emulsion sequence shown and the heretofore more common sequence in which the blue sensitive, yellow image layer is located outermost.

In each of FIGS. 2 through 9, a section of film is shown in which the center section has been illuminated by white light and the two outer sections have not been illuminated. Thus, if a light image is focused on the center of the uppermost surface of emulsion 18, in FIG. 2, the right and left hand portions of emulsions 14, 16 and 18 have not been illuminated or exposed, but the center portion of each of these emulsions has been exposed.

Without going into the theory of the photographic process, it is known that when light strikes a photographic emulsion, the silver halide within that emulsion experiences a subtle change and becomes a latent image. The unexposed silver halide experiences no change and does not become what is usually referred to as a latent image. Because the light which is assumed to be falling upon the central portion of the upper surface of the emulsion 18 is white light, this light will pass through all of the emulsions and expose the magenta, cyan, and yellow emulsions.

As indicated by the legend adjacent FIG. 2, the grains of silver halide that have been exposed to form a latent image are indicated by the stars in the emulsions, and the unexposed grains of silver halide are indicated by the circles enclosing the letters AgX.

Figure 1:
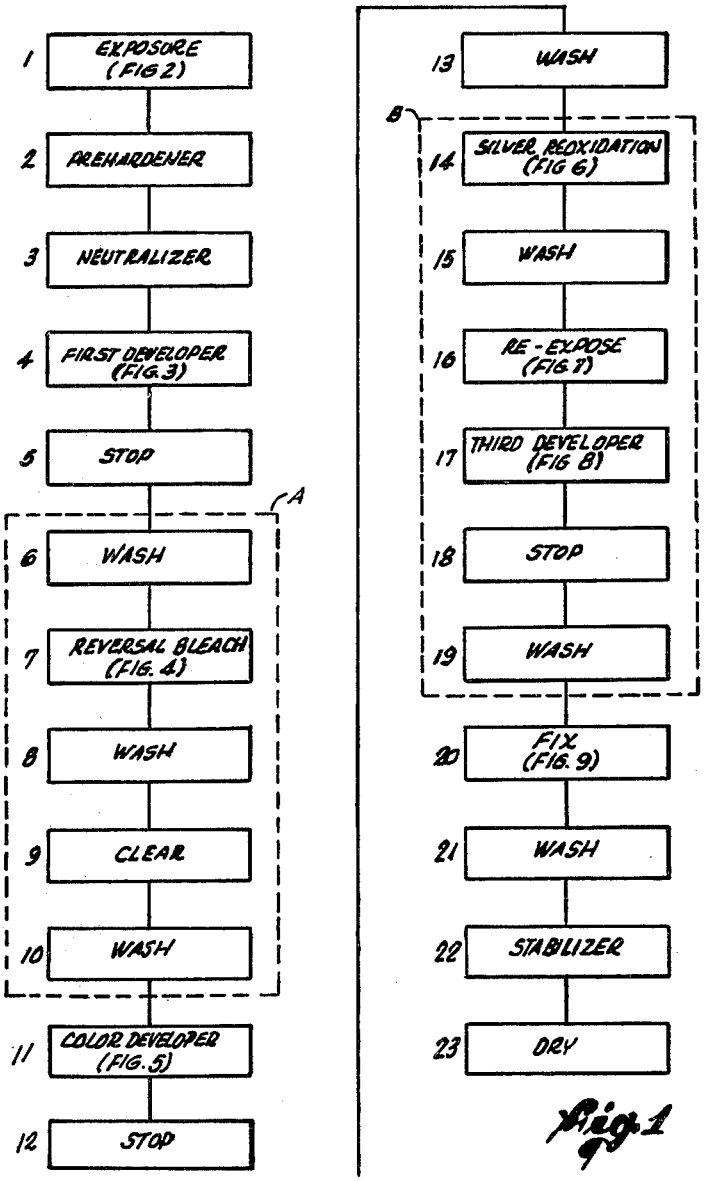
FIG. 1 is a flow-chart showing the steps in the production of a high resolution color image using a reversal process.

Turning now to FIG. 1 of the drawings, there is disclosed a flow-chart of the various steps in the processing of color film as set forth in this invention. This includes certain steps enclosed in blocks A and B and numbered 6 through 10, and 14 through 19, respectively, that are not found in conventional color film processing. A conventional process is set forth by Eastman Kodak Company in its publication "*Manual for Processing of Kodak and Eastman Ektachrome Film Using Kodak Process ME4*", wherein the description of the so-called ME4 process is given. In that process, after exposure, the film goes through a pre-hardener and then a neutralizer before being passed into a first developer which is a black and white developer. The film is thereafter passed through a stop bath and then washed. From there the film goes to a color developer, and when the color development is completed, the film then passes through a stop bath and is washed. Thereafter it is bleached, fixed, washed, stabilized and dried.

Additional information regarding the ME4 process is given in the publication of Eastman Kodak Co., Motion Picture and Education Markets Division, entitled "Function of Processing Steps and Certain Solution Components in Processing ECO-2 and ME-4 and Some Comments on Operation and Control", published in June 1968.

Figure 3:
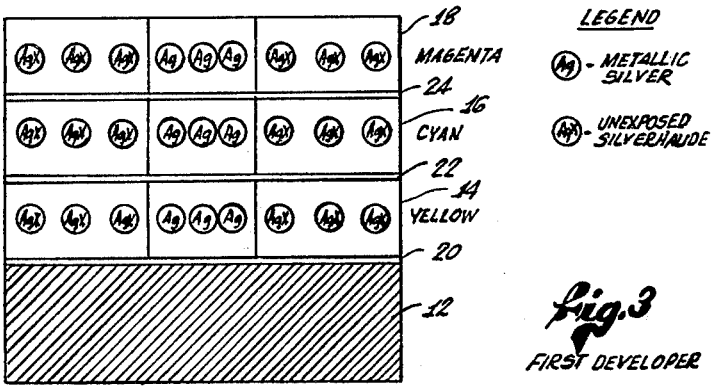
FIG. 3 is an enlarged fragmentary view similar to FIG. 2 showing the condition of the emulsions of the film after the first development has occurred.

As is known, the negative silver image formed by the first developer is in the form of metallic silver. The amount of metallic silver depends upon the extent of the exposure, and the metallic silver thus exists in the emulsion, together with the unexposed silver halide. This situation after the first development is indicated in FIG. 3, where it will be seen that the metallic silver is located in the central portion which was exposed to the white light while the unexposed silver halide is in each of the adjacent side sections of all three emulsions.

In the normal ME4 processing, the next step is the treatment of the film by the color developer which has the effect of simultaneously reducing the silver halide and forming a dye, the dye being formed only where the silver halide reduction takes place. Thus, if there is only a slight amount of silver halide at a particular point in the green sensitive magenta emulsion 18, only a slight amount of magenta dye will be formed at that point. On the other hand, if there is a large amount of unreduced silver halide at corresponding points in the cyan and yellow layers, there will be correspondingly greater amounts of the cyan and yellow images formed.

In order for the color development to act on the silver halide so that it may be reduced to metallic silver, the halide must be "fogged" either by exposure to light or by the use of a fogging agent in the color developer (see Friedman, "History of Color Photography", p. 122 and p. 182).

At this point, after color development, there will be the metallic silver crystals which were formed as a result of the first development, these crystals not having formed any dye images, and other silver crystals that have been formed during the color development phase of the process which crystals are associated with dye images.

The crystals formed by the first development may be considered as comprising the negative image, and the associated dye images form the complementary or positive image. The terms "positive" and "negative" are relative, and the first image may be a "positive", in which case the color image will be a "negative", but in each case the first image and the color image are complementary to each other.

The film is then run through a stop bath that immediately stops all further development, and is then washed. The film is then bleached in a solution that converts the metallic silver to a silver salt and thereafter this salt is removed by a fixing solution in the customary way. Washing and stabilizing of the film complete the process. The result of this procedure is a film having a color image composed entirely of the appropriate dyes and having no silver image at all. This conventional process is diagrammatically illustrated by eliminating steps 6 through 10 and 14 through 19 of the process indicated by the flowchart of FIG. 1.

Figure 4:
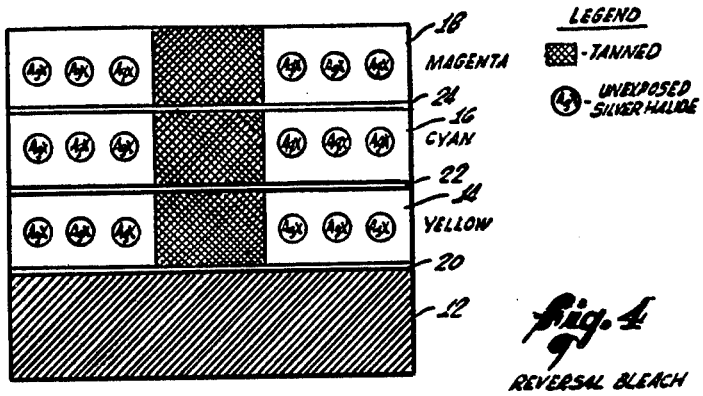
FIG. 4 is an enlarged fragmentary view similar to FIG. 2 showing the condition of the emulsions after the reversal bleach step has been completed.

The improved process has the metallic silver formed by the first developer removed immediately instead of keeping all of the silver, in either metallic silver or silver halide form, through the color development, step number 11. Thus, in FIG. 1, after the formation of the metallic silver negative image, step 4, that image is removed by a reversal bleach while the unexposed silver halide is not disturbed. The condition of the film at this time is indicated in FIG. 4.

It will be noted that this is an additional treatment, designated by the letter A in FIG. 1, and the added steps therein are steps 6 through 10 that include the steps of washing, reversal bleaching, washing, clearing, and washing again. In addition to removing the metallic silver, the reversal bleach also acts to tan or toughen the emulsion where the silver has been. This is indicated by the shaded areas in FIGS. 4 through 9. This tanning, for reasons not clearly understood, aids in improving the sharpness and resolution of the resulting image.

Figure 5:
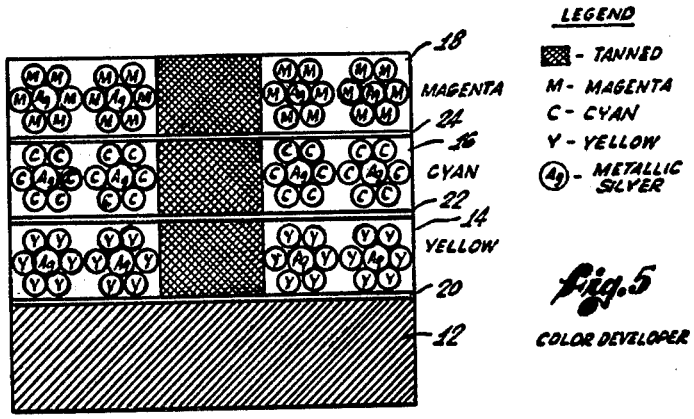
FIG. 5 is an enlarged fragmentary view of the emulsions similar to FIG. 2 showing the condition of the emulsions after the completion of color development.

After washing to remove the clearing solution, the film is processed through the color developer, step 11 as previously described, through the stop and wash steps 12 and 13, at which point the emulsions are in the condition indicated in FIG. 5.

Figure 6:
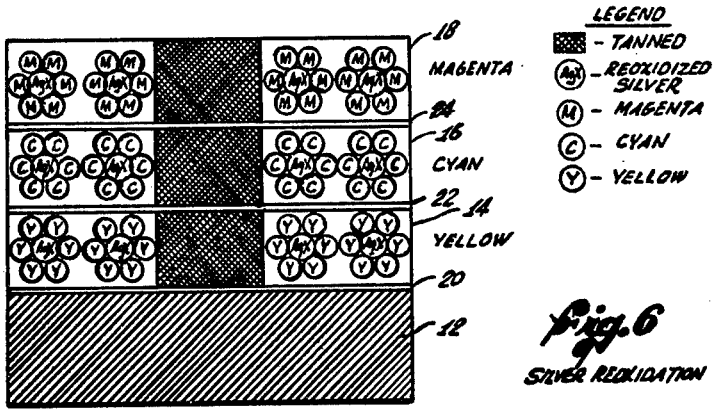
FIG. 6 is an enlarged fragmentary view similar to FIG. 2 and showing the condition of the emulsions after the completion of the silver re-oxidation step.

Since the negative silver image has been removed by the reversal bleach step, the silver that is left in association with the positive color image, and which is aligned or in register with the color image, is a positive silver image which darkens or degrades the color image. At this point the second modification of the conventional process occurs. This additional treatment, indicated by the letter B, comprises the steps 14 through 19 and includes the re-oxidation of the metallic silver to form a light-sensitive salt that is present in the emulsions and co-extensive with the dye images. This condition is illustrated in FIG. 6.

Figure 7:
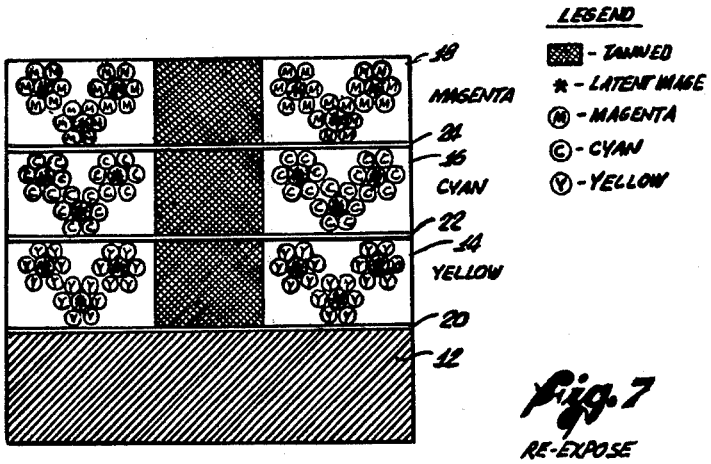
FIG. 7 is an enlarged fragmentary view of a portion of the emulsions after the film has been re-exposed by light during the processing.
Figure 8:
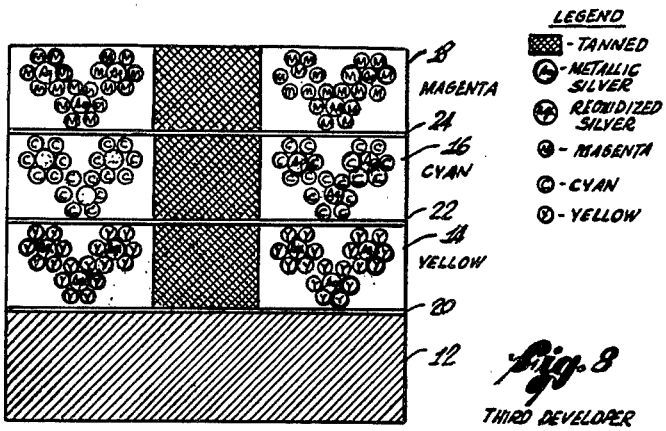
FIG. 8 is a view similar to FIG. 2 showing the condition of the emulsions after the completion of the third development.

After washing the film to remove the solution used to re-oxidize the silver, the film is then re-exposed to provide the latent images as indicated in FIG. 7. If desired, the re-exposure may be accomplished by ultraviolet light, which has the property of not penetrating deeply into the photographic emulsions but instead exposes only the outermost silver halide. Thereafter, the film is again developed, as indicated in step 17. This third development of the film is carefully controlled so that only the latent image in the outermost emulsion layer is developed and the images in the second and third layers are substantially unaffected. The reason for this careful control is that the image that has been formed on the outermost layer is the sharpest of all three images and acts to greatly increase the resolution of the film. The images formed in the middle and innermost emulsions are much more diffused because of the scattering of the light in its passage through the emulsions, and consequently, the presence of the other images and the middle and innermost emulsions actually tends to degrade the results that can be obtained by keeping the image only on the outermost layer. It will be realized that it is not always possible in commercial operations to restrict the silver image solely to the outermost layer, though this is the desired condition. So long as the principal silver image is in the outermost layer, the presence of a much fainter image in a more inward layer will not defeat the superior effect of the principal image.

Figure 9:
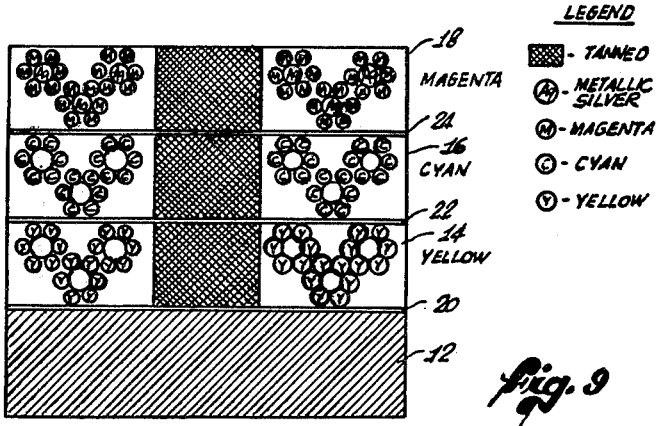
FIG. 9 is an enlarged fragmentary view similar to FIG. 2 showing the condition of three emulsions after the final fixing has been completed.

After development of the film in the third developer to provide the metallic silver image in the outermost layer, leaving unaffected the silver halide in the intermediate and innermost emulsions, the film is passed through a stop bath and washed before passing into a fixing bath, step 20. At this point the various emulsions are indicated in FIG. 9 where each of the emulsions has its own respective color image and in addition the outermost emulsion has a silver image.

The process is completed by the washing, stabilizing, and drying of the film.

While all of the solutions in steps 1 through 5, 11 through 13, and 20 through 23, are substantially the same as those customarily used, the first developer, step 4, and the color developer, step 11, are slightly modified. Thus where the first developer normally has 5.50 grams of hydroquinone per liter and 1.38 grams of sodium thiocyanate per liter, the hydroquinone is increased to 33.5 grams per liter and the sodium thiocyanate is increased to 3.08 grams per liter. The pH is changed from 9.90 to 10.15.

The effects of these changes in the composition the first developer are to steepen the response curve and also to compress or shorten the shoulder of the response curve.

The effect of the extra hydroquinone is to increase the contrast of the negative image and the effect of the thiocyanate is to decrease the size of the shoulder between the sloping straight line portion of the response curve and the flat maximum response. Both of these features are very desirable for increasing the edge sharpness of the resulting positive image that is later secured by reversal and third development.

The color developer used in step 11 is modified by increasing the amount of citrazinic acid from 1.50 grams to 1.90 grams per liter and the pH is changed from 11.65 to 11.85.

The solutions used in the other steps of the conventional color reversal processing are unchanged. However, it will be recognized that there are certain additional steps, those of Group A and Group B, that constitute chemical treatment beyond the normal washing.

Thus, in Group A, including steps 6 through 10, the film, in addition to being washed in step 6, is treated in a reversal bleach, step 7, and then washed, cleared and washed again. The reversal bleach consists of a well-known bleach formula as follows:

| | |
|---|---|
| Water | 800 ml |
| Potassium Dichromate | 30 g |
| Water to make | 1000 ml |
| Adjust pH with sulfuric acid to | 1.0 ± 0.2 |

The clearing bath that is used after the reversal bleach is as follows:

| | |
|---|---|
| Water | 800 ml |
| Sodium Sulfite | 100 g |
| Water to make | 1000 ml |
| pH as is | 10.5 |

The steps in part B, steps 14 through 19 inclusive, include a silver re-oxidation bath, step 14, and a third developer, step 17. The silver re-oxidation, step 14, is accomplished in a solution that may be compounded as follows:

| | |
|---|---|
| Water | 800 ml |
| Sodium Bromide, Anhydrous | 43.0 g |
| Potassium Ferricyanide, Anhydrous | 165.0 g |
| Borax ($Na_2B_4O_7 \cdot H_2O$) | 1.0 g |
| Polyethylene Glycol | 3.6 g |
| Sodium Hydroxide or Sulfuric Acid | to adjust pH |
| Water to | 1.0 liter |
| pH at 80° F. | 8.70 ± 0.15 |

It will be recognized that this is the ferricyanide bleach set forth in the Eastman Kodak instructions for the ME4 process mentioned above and the function of the bleach is to convert the metallic silver to a light sensitive silver salt.

The third developer is a so-called soft-working developer compounded as follows:

| | |
|---|---|
| Water | 800 ml |
| Calgon (Sodium hexametaphosphate) | 1.0 g |
| Sodium Sulfite | 5.0 g |
| Metol | 7.0 g |
| Sodium Sulfate | 50.0 g |
| Sodium Bromide | 0.25 g |
| Sodium Carbonate (Mono) | 10.0 g |
| Water to make | 1000 ml |
| Adjust pH with Sodium Hydroxide to | 10.20 |

The time for each of the various steps and the temperature at which it is to be performed are set out below:

| Processing Step | Time (Seconds) | Temp. °F. |
|---|---|---|
| Prehardener | 120 | 95 ± 1 |
| Neutralizer | 60 | 93 ± 2 |

-continued

| Processing Step | Time (Seconds) | Temp. °F. |
|---|---|---|
| First Developer | 155 | 93 ± ¼ |
| Stop | 60 | 93 ± 2 |
| Wash | 60 | 85 ± 5 |
| Reversal Bleach | 60 | 75 ± 2 |
| Wash | 60 | 75 ± |
| Clear | 60 | 75 ± 2 |
| Wash | 60 | 85 ± 5 |
| Color Developer | 255 | 98 ± 1 |
| Stop | 60 | 93 ± 2 |
| Wash | 60 | 85 ± 5 |
| Silver Re-oxidation | 60 | 100 ± 5 |
| Wash | 60 | 85 ± 5 |
| Re Expose | 5–7 | — |
| Third Developer | 22 | 70 ± ¼ |
| Stop | 60 | 93 ± 2 |
| Fix | 60 | 100 ± 5 |
| Wash | 60 | 85 ± 5 |
| Stabilizer | 60 | Equilibrium |

Re-exposure is accomplished by using a No. 2 Photoflood Lamp at 18 inches from the emulsion side.

As previously mentioned it is very important to restrict, so far as possible, the development by the third developer to the outermost layer of emulsion, and consequently it will be noted that the temperature of that solution is the coldest of all the solutions and the time of treatment is the shortest of all of the chemical treatments. Furthermore, there is no mechanical agitation of the third developer such as might be provided by jets or spray developing, since it is important that the action of the developer be restricted to the surface of the film, and the actual movement of the film through the solution causes sufficient agitation.

While the process has been described as being applied to a color reversal film, it will be apparent that the same general results may be obtained in the processing of color negative and color positive films, Thus in processing a color negative where no first developer is used, steps 4 through 9 of the herein-described process may be omitted. In this manner, the normal processing steps are followed through color development and thereafter the film is treated by a stop bath and then washed. The unexposed silver is then removed by a fixing bath and washed, corresponding to steps 20 and 21, and the process of section B is then followed. The result will be a negative color film having a negative silver image in the outermost emulsion layer. If it is decided to make a positive color print, the same general sequence of steps will be followed as set forth for the color negative.

From the foregoing it will be seen that a method for processing color film has been provided that is fully capable of achieving the results and securing the advantages heretofore set forth. While a preferred method of performing the invention has been described, it will be recognized that modifications are permissible and the patent is not to be limited to the particular chemicals used, the times and temperatures or the particular steps or sequence set forth except as limited by the following claims:

I claim:

1. The method of processing an exposed multi-emulsion layer color film containing silver halide which includes the steps of:

developing said film to form first black and white images formed of metallic silver in said emulsions;

tanning bleaching said first black and white images to remove the metallic silver thereof;

color developing said film in the presence of color couplers to form color images having metallic silver images therewith that are complementary to said first black and white images;

re-oxidizing said complementary metallic images;

re-exposing the re-oxidized image in the outermost of said emulsions, said re-exposing being substantially limited to said outermost emulsion;

developing said re-exposed image in said outermost emulsion to form a silver image therein; and removing the re-oxidized metallic layers not developed to leave a silver image only in said outermost layer; so as to form a processed film with an outermost layer comprising metallic silver and magenta, an intermediate cyan layer, and a bottom yellow layer, and wherein portions of the layers not containing said color are tanned, whereby the combination of the silver and magenta in the outermost layer with the tanned portions provides an increased resolution then absent said combination.

2. The method of processing a multi-emulsion exposed color film containing silver halide and color couplers which includes the steps of:

developing said film to form first black and white images formed of metallic silver in said emulsions;

tanning bleaching said first black and white images to remove the metallic silver thereof;

color developing said film to form color images having metallic silver images therewith that are complementary to said first black and white images;

re-oxidizing said complementary metallic images;

re-exposing the re-oxidized image in the outermost of said emulsions, said re-exposing being substantially limited to said outermost emulsion;

developing said re-exposed image in said outermost emulsion to form a silver image therein; and removing the re-oxidized metallic images not developed to a silver image in said outermost layer, whereby the developed film has a higher resolution than absent said processing.

3. The method of processing an exposed multilayer, silver halide emulsion color film which comprises steps of:

developing said film to form first black and white images formed of metallic silver in said emulsions;

bleaching said first black and white images to remove the metallic silver thereof and tanning the non-image portion;

color developing said film in the presence of color couplers to form color images associated therewith that are complementary to said first black and white images, wherein the amount of metallic silver and the associated amount of color are directly proportional to each other.

re-oxidizing said complementary metallic images;

re-exposing the re-oxidized image in the outermost of said emulsions, said re-exposing being substantially limited to said outermost emulsion;

developing said re-exposed image in said outermost emulsion to form a silver image therein; and removing the re-oxidized metallic layers not developed to leave a silver image only in said outermost layer; wherein the color image in the outermost layer is associated with the silver image in the outermost layer, and the color images in the inner layers are proportional to the respective inner explosure, whereby the developed film has a higher resolution than absent said film processing.

4. A method of processing exposed multi-emulsion layer color film which comprises;

developing said film to form black and white images of silver;

bleaching said images to remove the silver, and tanning the non-image portion;

color developing said film in the presence of color couplers;

selectively providing a silver image associated with the color image in the outermost layer only;

whereby the developed film has a higher resolution than absent said processing.

5. The method of claim 1, wherein re-exposing, the light penetrates substantially only the outermost layer.

6. The method of claim 1, wherein the re-exposing light is ultraviolet light on the emulsion side of the film.

7. The method of claim 1, wherein the image in the outermost layer is the sharpest of the layer images.

8. The method of claim 3, wherein removing the re-oxidized metallic layers, the color associated therewith is not removed.

9. The method of claim 3, wherein the silver image and the color image in said outermost layer are both determined by the original exposure.

10. The method of claim 3, wherein the silver image is a positive image and the color image in the outermost layer is a positive image.

11. The method of claim 3, wherein the silver image is a negative image and the color image in the outermost layer is a negative image.

12. The method of claim 4, wherein the outermost layer image is sharper than the others in the developed film.

13. The method of claim 4, wherein the outermost layer comprises silver and magenta.

14. The method of claim 4, wherein the silver image is a positive image and the color image in the outermost layer is a positive image.

15. The method of claim 4, wherein the silver image is a positive image and the color image in the outermost layer is a positive image, and is sharper than any other layer in the developed film.

16. The method of claim 4, wherein the silver image is a negative image and the color image in the outermost layer is a negative image.

* * * * *